US006190847B1

(12) United States Patent
Sowinski et al.

(10) Patent No.: US 6,190,847 B1
(45) Date of Patent: Feb. 20, 2001

(54) COLOR NEGATIVE FILM FOR PRODUCING IMAGES OF REDUCED GRANULARITY WHEN VIEWED FOLLOWING ELECTRONIC CONVERSION

(75) Inventors: Allan F. Sowinski; Richard P. Szajewski, both of Rochester; Frank R. Brockler, Macedon; Edward J. Giorgianni, Rochester; John D. Buhr, Webster; Lois A. Buitano, Rochester; Maria J. Gonzalez, Pittsford, all of NY (US)

(73) Assignee: Eastman Kodak Company, Rochester, NY (US)

( * ) Notice: Under 35 U.S.C. 154(b), the term of this patent shall be extended for 0 days.

(21) Appl. No.: 09/066,137

(22) Filed: Apr. 24, 1998

Related U.S. Application Data

(63) Continuation-in-part of application No. 08/940,527, filed on Sep. 30, 1997, now abandoned.

(51) Int. Cl.[7] ..... G03C 7/30; G03C 7/305

(52) U.S. Cl. ..... 430/544; 430/359; 430/505; 430/506; 430/546

(58) Field of Search ..... 430/359, 544, 430/546, 505, 506

(56) References Cited

U.S. PATENT DOCUMENTS

| | | | | |
|---|---|---|---|---|
| 4,184,876 | | 1/1980 | Eeles et al. | 430/505 |
| 4,524,130 | | 6/1985 | Iwasa et al. | 430/505 |
| 5,169,746 | * | 12/1992 | Sasaki | 430/504 |
| 5,183,727 | | 2/1993 | Schmittou et al. | 430/372 |
| 5,219,715 | | 6/1993 | Sowinski et al. | 430/376 |
| 5,267,030 | | 11/1993 | Giorgianni et al. | 430/527 |
| 5,298,376 | | 3/1994 | Szajewski et al. | 430/505 |
| 5,314,792 | * | 5/1994 | Merrill | 430/505 |
| 5,318,880 | | 6/1994 | English et al. | 430/393 |
| 5,376,519 | * | 12/1994 | Merkel et al. | 430/546 |
| 5,455,146 | | 10/1995 | Nishikawa et al. | 430/383 |
| 5,609,978 | | 3/1997 | Giorgianni et al. | 430/30 |
| 5,698,379 | | 12/1997 | Bohan et al. | 430/359 |
| 5,804,356 | * | 9/1998 | Cole et al. | 430/359 |
| 5,840,470 | * | 11/1998 | Bohan et al. | 430/359 |
| 5,998,106 | * | 12/1999 | Merker et al. | 430/544 |
| 5,998,107 | * | 12/1999 | Merkel et al. | 430/544 |

FOREIGN PATENT DOCUMENTS

| | | |
|---|---|---|
| 271 061 | 12/1987 | (EP) . |
| 566 417 A2 | 4/1993 | (EP) . |
| 747 759 A2 | 4/1993 | (EP) . |

OTHER PUBLICATIONS

Research Disclosure, Item 389567, X. vol. 389, Sep. 1996.
Research Disclosure, Item 38957. XII, vol. 389, Sep. 1996.

* cited by examiner

*Primary Examiner*—Janet Baxter
*Assistant Examiner*—Amanda C. Walke
(74) *Attorney, Agent, or Firm*—Arthur E. Kluegel

(57) ABSTRACT

A color negative silver halide photographic element is disclosed that is capable of producing images that, when converted to electronic form and then converted to a viewable form, exhibit reduced granularity. The photographic elements contain blue, green and red recording layer units capable of forming spectrally differentiated dye images. The layer units are substantially free of masking coupler, each exhibit a dye image gamma of less than 1.5 and an exposure latitude of at least 2.7 log E. Greater than 50 mole percent of development inhibitor compound in at least one of the layer units exhibits a diffusion factor of less than 0.4.

12 Claims, 1 Drawing Sheet

COLOR NEGATIVE FILM FOR PRODUCING IMAGES OF REDUCED GRANULARITY WHEN VIEWED FOLLOWING ELECTRONIC CONVERSION

This is a continuation-in-part of U.S. Ser. No. 08/940,527, filed Sep. 30, 1997 (now abandoned).

FIELD OF THE INVENTION

The present invention relates to color negative films intended to create images for scanning, electronic manipulation, and reconversion to a viewable form.

DEFINITION OF TERMS

The term "E" is used to indicate exposure in lux-seconds.

The term "gamma" is employed to indicate the incremental increase in image density (ΔD) produced by a corresponding incremental increase in log exposure (Δlog E) and indicates the maximum gamma measured over an exposure range extending between a first characteristic curve reference point lying at a density of 0.15 above minimum density and a second characteristic curve reference point separated from the first reference point by 0.9 log E.

The term "exposure latitude" indicates the exposure range of a characteristic curve segment over which instantaneous gamma (ΔD/Δlog E) differs from gamma, as defined above, by no more than 25 percent.

The term "coupler" indicates a compound that reacts with oxidized color developing agent to create or modify the hue of a dye chromophore.

In referring to blue, green and red recording dye image-forming layer units, the term "layer unit" indicates the hydrophilic colloid layer or layers that contain radiation-sensitive silver halide grains to capture exposing radiation and couplers that react upon development of the grains. The grains and couplers are usually in the same layer, but can be in adjacent layers.

The term "colored masking coupler" indicates a coupler that is initially colored and that loses its initial color during development upon reaction with oxidized color developing agent.

The term "substantially free of colored masking coupler" indicates a coating coverage of less than 0.09 millimole/$m^2$ of colored masking coupler in a dye image-forming layer unit.

The term "dye image-forming coupler" indicates a coupler that reacts with oxidized color developing agent to produce a dye image.

The term "absorption half-peak bandwidth" indicates the spectral range over which a dye exhibits an absorption equal to at least half of its peak absorption.

The term "development inhibitor releasing compound" or "DIR" indicates a compound that cleaves to release a development inhibitor during color development. As defined DIR's include couplers and other compounds that utilize anchimeric and timed releasing mechanisms.

The term "diffusion factor" in referring to development inhibitor releasing compounds indicates the extent of diffusion of the released development inhibitor. A higher diffusion factor indicates a higher extent of released inhibitor diffusion. DIR diffusion factors are quantified by the procedure described in the Diffusion Factor section of the Examples, below.

In referring to grains and emulsions containing two or more halides, the halides are named in order of ascending concentrations.

In referring to grains, "ECD" indicates mean equivalent circular diameter and, in describing tabular grains, "t" indicates mean tabular grain thickness.

References to blue, green and/or red spectral sensitizing dyes indicate dyes that absorb blue, green or red light and transfer absorbed photon energy to silver halide grains when adsorbed to their surfaces.

Research Disclosure is published by Kenneth Mason Publications, Ltd., Dudley House, 12 North St., Emsworth, Hampshire P010 7DQ, England.

BACKGROUND

Color negative photographic elements are conventionally formed with superimposed blue, green and red recording layer units coated on a support. The blue, green and red recording layer units contain radiation-sensitive silver halide emulsions that form a latent image in response to blue, green and red light, respectively. Additionally, the blue recording layer unit contains a yellow dye image-forming coupler, the green recording layer unit contains a magenta dye image-forming coupler, and the red recording layer unit contains a cyan dye image-forming coupler. Following imagewise exposure, the photographic elements are processed in a color developer, which contains a color developing agent that is oxidized while selectively reducing to silver latent image-bearing silver halide grains. The oxidized color developing agent then reacts with the dye image-forming coupler in the vicinity of the developed grains to produce an image dye. Yellow (blue-absorbing), magenta (green-absorbing) and cyan (red-absorbing) image dyes are formed in the blue, green and red recording layer units respectively. Subsequently the element is bleached (i.e., developed silver is converted back to silver halide) to eliminate neutral density attributable to developed silver and then fixed (i.e., silver halide is removed) to provide stability during subsequent room light handling.

When processing is conducted as noted above, negative dye images are produced. To produce a viewable positive dye image and hence to produce a visual approximation of the hues of the subject photographed, white light is typically passed through the color negative image to expose a second color photographic element having blue, green and red recording layer units as described above, usually coated on a white reflective support. The second element is commonly referred to as a color print element, and the process of exposing the color print element through the image-bearing color negative element is commonly referred to as printing. Processing of the color print element as described above produces a viewable positive image that approximates that of the subject originally photographed.

A problem with the accuracy of color reproduction delayed the commercial introduction of color negative elements. In color negative imaging two dye image-forming coupler containing elements are exposed and processed to arrive at a viewable positive image. The dye image-forming couplers each produce dyes that only approximate an absorption profile corresponding to that recorded by the silver halide grains. Since the color negative element cascades its color errors forward to the color print element, the cumulative error in the final print is unacceptably large, absent some form of color correction.

A commercially acceptable solution that remains in use today in the form of color slides is to subject a color photographic element having blue, green and red recording layer units to reversal processing. In reversal processing the film is first black-and-white processed to develop exposed silver halide grains imagewise without formation of a corresponding dye image. Thereafter, the remaining silver halide grains are rendered developable. Color development followed by bleaching and fixing produces a viewable color image corresponding to the subject photographed. The primary objections to this approach are (a) the more complicated processing required and (b) the absence of an opportunity to correct underexposures and overexposures, as is provided during exposure of a print element.

Commercial acceptance of color negative elements occurred after commercial introduction of the first color reversal films. The commercial solution to the problem of cascaded color error has been to place colored masking couplers in the color negative element at concentrations of greater than 0.12 (typically greater than 0.25) millimole/$m^2$. Illustrations of colored masking couplers are provided by Research Disclosure, Vol. 389, September 1996, Item 38957, XII. Features applicable only to color negative, paragraphs (1) and (2). The colored masking couplers lose or change their color in areas in which grain development occurs producing a dye image that is a reversal of the unwanted absorption of the image dye. This has the effect of neutralizing unwanted spectral absorption by the image dyes by raising the neutral density of the processed color negative element. In practical applications this is not a difficulty, since increased neutral minimum densities are easily offset by increasing exposure levels when exposing the print element through the color negative element.

In color negative films in which silver coating coverages are significantly reduced it is in some instances difficult to obtain a desired level of image descrimination ($D_{max}$–$D_{min}$) when masking couplers are present. The following patents include examples of color negative films in which masking couplers have been omitted: Schmittou et al U.S. Pat. No. 5,183,727 (Element I), Sowinski et al U.S. Pat. Nos. 5,219,715 and 5,322,766 (Element III), English et al U.S. Pat. No. 5,318,880 (Sample 108), and Szajewski et al U.S. Pat. No. 5,298,376 (Samples 301 and 302). In limiting silver coating coverages these patents have not exhibited the degree of exposure latitude normally desired for color negative films.

It should be noted that colored masking couplers have no applicability to reversal color elements intended for direct viewing. They actually increase visually objectionable dye absorption in a color negative film, super-imposing an overall salmon colored tone, which can be tolerated only because color negative images are not intended to be viewed. On the other hand, color reversal images are made to be viewed, but not printed. Thus colored masking couplers, if incorporated in reversal films, would be visually objectionable and serve no useful purpose.

In addition to incorporating colored masking couplers in color negative photographic elements it has been recognized that improved dye images can be realized by incorporating one or more developer inhibitor releasing compounds in the dye image-forming layer units. The development inhibitor, which increases in mobility by release during color development, improves the dye image by interacting with adjacent layer units to create favorable interimage effects and by sharpening dye image edge definition. Illustrations of development inhibitor releasing compounds are provided by Research Disclosure, Item 38957, cited above, X. Dye image formers and modifiers, C. Image dye modifiers.

Selection of suitable DIR compounds based on a measured diffusion factor is illustrated by Iwasa et al U.S. Pat. No. 4,524,130. Iwasa et al addresses the problem of providing color negative photographic elements that provide improved color print enlargements. The problem is addressed by employing in combination radiation-sensitive silver halide emulsion layers differing in iodide content and containing DIR's having diffusion factors of 0.4 or higher. Iwasa et al makes no mention of adapting color negative photographic elements for producing images that are of improved quality when converted to digital form and then reconstructed for viewing.

Techniques for scanning color negative films to obtain viewable images are well known, as illustrated by Giorgianni et al U.S. Pat. No. 5,267,030 and Bohan et al U.S. Pat. No. 5,698,379.

SUMMARY OF THE INVENTION

In one aspect this invention is directed to a color negative photographic element for producing a color image suited for conversion to an electronic form and subsequent reconversion into a viewable form comprised of a support and, coated on the support, a plurality of hydrophilic colloid layers, including radiation-sensitive silver halide emulsion layers, forming layer units for separately recording blue, green and red exposures, each of the layer units containing dye image-forming coupler chosen to produce image dye having an absorption half-peak bandwidth lying in a different spectral region in each layer unit, wherein the layer units are substantially free of colored masking coupler, the layer units each contain at least 0.8 g/$m^2$ of silver in the form of silver halide and exhibit a dye image gamma of from 0.2 to less than 1.5 and an exposure latitude of at least 2.7 log E, where E is exposure measured in lux-seconds, development inhibitor releasing compound is present in at least one of layer units, and greater than 50 mole percent of the development inhibitor compound in at least one of the layer units exhibits a diffusion factor of less than 0.4.

It has been discovered quite unexpectedly that color negative photographic elements constructed as described above produce images for viewing of improved quality, where the images are obtained by scanning the exposed and processed color negative elements to obtain a manipulatible electronic record of the image pattern, followed by reconversion of the adjusted electronic record to a viewable form. Since the color negative photographic elements are not intended to be used for printing, colored masking couplers are not required. Further, it has been surprisingly observed that granularity in a dye image to be viewed is markedly reduced when at least 50 mole percent of the development inhibitor releasing compound present in the dye image-forming layer unit exhibits a diffusion factor of less than 0.4. This is, of course, directly contrary to the teachings of Iwasa et al of constructing color negative photographic elements intended to be used for printing to incorporate development inhibitor releasing compounds having a diffusion factor of 0.4 or more.

DESCRIPTION OF PREFERRED EMBODIMENTS

Figure 1:
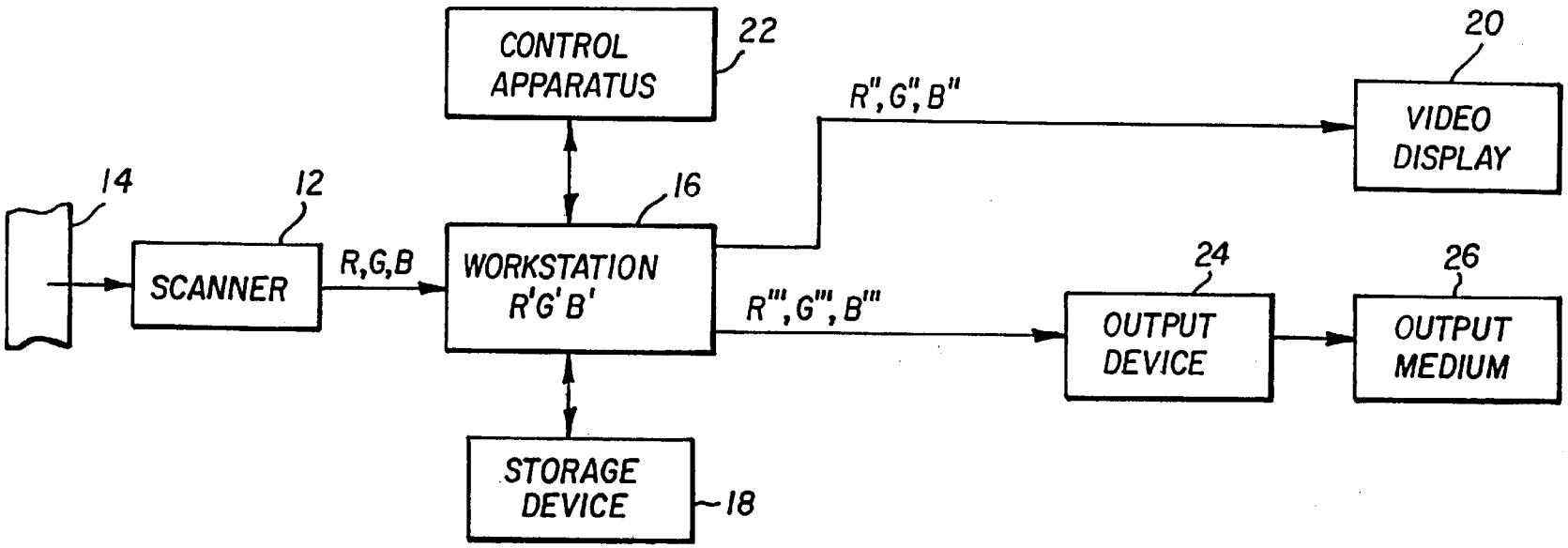
FIG. 1 shows in block diagram form a color imaging system for processing image information obtained by scanning the color negative elements of the invention.

Typical color negative film constructions useful in the practice of the invention are illustrated by the following:

Element SCN-1

SOC Surface Overcoat
BU Blue Recording Layer Unit

IL1 First Interlayer
GU Green Recording Layer Unit
IL2 Second Interlayer
RU Red Recording Layer Unit
S Support
AHU Antihalation Layer Unit
SOC Surface Overcoat Element SCN-1A SOC Surface Overcoat
BU Blue Recording Layer Unit
IL1 First Interlayer
GU Green Recording Layer Unit
IL2 Second Interlayer
RU Red Recording Layer Unit
AHU Antihalation Layer Unit
S Support
MRU Magnetic Recording Layer Unit The support S can be either reflective or transparent, which is usually preferred. When reflective, the support is white and can take the form of any conventional support currently employed in color print elements. When the support is transparent, it can be colorless or tinted and can take the form of any conventional support currently employed in color negative elements—e.g., a colorless or tinted transparent film support. Details of support construction are well understood in the art. Transparent and reflective support constructions, including subbing layers to enhance adhesion, are disclosed in Research Disclosure, Item 38957, cited above, XV. Supports.

The magnetic recording layer unit MRU can be conventionally constructed, as illustrated by Research Disclosure, Item 38957, XIV. Scan facilitating features, paragraph (2).

Each of blue, green and red recording layer units BU, GU and RU are formed of one or more hydrophilic colloid layers and contain at least one radiation-sensitive silver halide emulsion and coupler, including at least one dye image-forming coupler. In the simplest contemplated construction each of the layer units consists of a single hydrophilic colloid layer containing emulsion and coupler. When coupler present in a layer unit is coated in a hydrophilic colloid layer other than an emulsion containing layer, the coupler containing hydrophilic colloid layer is positioned to receive oxidized color developing agent from the emulsion during development. Usually the coupler containing layer is the next adjacent hydrophilic colloid layer to the emulsion containing layer.

The emulsion in BU is capable of forming a latent image when exposed to blue light. When the emulsion contains high bromide silver halide grains and particularly when minor (0.5 to 20, preferably 1 to 10, mole percent, based on silver) amounts of iodide are also present in the radiation-sensitive grains, the native sensitivity of the grains can be relied upon for absorption of blue light.

Preferably the emulsion is spectrally sensitized with one or more blue spectral sensitizing dyes. The emulsions in GU and RU are spectrally sensitized with green and red spectral sensitizing dyes, respectively, in all instances, since silver halide emulsions have no native sensitivity to green and/or red (minus blue) light.

Any convenient selection from among conventional radiation-sensitive silver halide emulsions can be incorporated within the layer units. Most commonly high bromide emulsions containing a minor amount of iodide are employed. To realize higher rates of processing high chloride emulsions can be employed. Radiation-sensitive silver chloride, silver bromide, silver iodobromide, silver iodochloride, silver chlorobromide, silver bromochloride, silver iodochlorobromide and silver iodobromochloride grains are all contemplated. The grains can be either regular or irregular (e.g., tabular). Tabular grain emulsions, those in which tabular grains account for at least 50 (preferably at least 70 and optimally at least 90) percent of total grain projected area are particularly advantageous for increasing speed in relation to granularity. To be considered tabular a grain requires two major parallel faces with a ratio of its equivalent circular diameter (ECD) to its thickness of at least 2. Specifically preferred tabular grain emulsions are those having a tabular grain average aspect ratio of at least and, optimally, greater than 8. Preferred mean tabular grain thicknesses are less than 0.3 $\mu$m (most preferably less than 0.2 $\mu$m). Ultrathin tabular grain emulsions, those with mean tabular grain thicknesses of less than 0.07 $\mu$m, are specifically preferred. The grains preferably form surface latent images so that they produce negative images when processed in a surface developer.

Illustrations of conventional radiation-sensitive silver halide emulsions are provided by Research Disclosure, Item 38957, cited above, I. Emulsion grains and their preparation. Chemical sensitization of the emulsions, which can take any conventional form, is illustrated in section IV. Chemical sensitization. Spectral sensitization and sensitizing dyes, which can take any conventional form, are illustrated by section V. Spectral sensitization and desensitization. The emulsion layers also typically include one or more antifoggants or stabilizers, which can take any conventional form, as illustrated by section VII. Antifoggants and stabilizers.

BU contains at least one yellow dye image-forming coupler, GU contains at least one magenta dye image-forming coupler, and RU contains at least one cyan dye image-forming coupler. Any convenient combination of conventional dye image-forming couplers can be employed. Conventional dye image-forming couplers are illustrated by Research Disclosure , Item 38957, cited above, X. Dye image formers and modifiers, B. Image-dye-forming couplers.

Contrary to conventional color negative film constructions, RU, GU and BU are each substantially free of colored masking coupler. Preferably the layer units each contain less than 0.05 (most preferably less than 0.01) millimole/$m^2$ of colored masking coupler. No colored masking coupler is required in the color negative elements of this invention.

Development inhibitor releasing compound is incorporated in at least one and, preferably, each of the layer units. DIR's are commonly employed to improve image sharpness and to tailor dye image characteristic curve shapes. The DIR's contemplated for incorporation in the color negative elements of the invention can release development inhibitor moieties directly or through intermediate linking or timing groups. The DIR's are contemplated to include those that employ anchimeric releasing mechanisms. Illustrations of development inhibitor releasing couplers and other compounds useful in the color negative elements of this invention are provided by Research Disclosure, Item 38957, cited above, X. Dye image formers and modifiers, C. Image dye modifiers, particularly paragraphs (4) to (11).

It has been discovered that the granularity (noise) observed following scanning an imagewise exposed and processed color negative photographic element according to the invention and then recreating a viewable image from the electronic record obtained by scanning is reduced in those color records in which at least 50 mole percent of the DIR present exhibits low diffusion—quantitatively, a diffusion factor of less than 0.4. In other words a preponderance (>50 mole %) of DIR's with low, less than 0.4, diffusion factors in a dye image-forming layer unit decreases the granularity of the layer unit. Preferably, each of the dye image-forming layer units in the color negative elements of the invention contain DIR's with at least 50 (optimally 70) mole percent of the DIR's having a diffusion factor of less than 0.4.

This selection of DIR's is contrary to that sought for color negative elements used for printing to obtain a viewable color image. Greater than 50 mole percent and, more typically, approximately 70 mole percent, of the DIR's present in dye image-forming layer units of color negative elements employed for printing have a diffusion factor of greater than 0.4. This selection of a high proportion of DIR's with high diffusion factors produces the best overall balance of image qualities in a viewable color image produced by printing.

It is the recognition of this invention that image noise can be reduced by selecting a preponderance of DIR's that exhibit a low diffusion factor while avoiding or minimizing other performance deficiencies, where the color record is placed in an electronic form prior to recreating a color image to be viewed. Whereas it is impossible to separate image noise from the remainder of the image information, either in printing or by manipulating an electronic image record, it is possible by adjusting an electronic image record that exhibits low noise, as is provided by the color negative elements of the invention, to improve overall curve shape and sharpness characteristics in a manner that is impossible to achieve by known printing techniques. Thus, images can be recreated from electronic image records derived from the color negative elements of the invention that are superior to those similarly derived from conventional color negative elements constructed to serve printing applications.

The remaining elements SOC, IL1, IL2 and AHU of the elements SCN-1 and SCN-1a are optional and can take any convenient conventional form.

The interlayers IL1 and IL2 are hydrophilic colloid layers having as their primary function color contamination reduction—i.e., prevention of oxidized developing agent from migrating to an adjacent recording layer unit before reacting with dye-forming coupler. The interlayers are in part effective simply by increasing the diffusion path length that oxidized developing agent must travel. To increase the effectiveness of the interlayers to intercept oxidized developing agent, it is conventional practice to incorporate an oxidized developing agent scavenger. When one or more silver halide emulsions in GU and RU are high bromide emulsions and, hence have significant native sensitivity to blue light, it is preferred to incorporate a yellow filter, such as Carey Lea silver or a yellow processing solution decolorizable dye, in IL1. Suitable yellow filter dyes can be selected from among those illustrated by Research Disclosure, Item 38957, VIII. Absorbing and scattering materials, B. Absorbing materials. Antistain agents (oxidized developing agent scavengers) can be selected from among those disclosed by Research Disclosure, Item 38957, X. Dye image formers and modifiers, D. Hue modifiers/stabilization, paragraph (2).

The antihalation layer unit AHU typically contains a processing solution removable or decolorizable light absorbing material, such as one or a combination of pigments and dyes. Suitable materials can be selected from among those disclosed in Research Disclosure, Item 38957, VIII. Absorbing materials. AHU can be located between the support S and the recording layer unit coated nearest the support or on the opposite side of the support, independently of whether a magnetic recording layer unit is included.

The surface overcoats SOC are hydrophilic colloid layers that are provided for physical protection of the color negative elements during handling and processing. Each SOC also provides a convenient location for incorporation of addenda that are most effective at or near the surface of the color negative element. In some instances the surface overcoat is divided into a surface layer and an interlayer, the latter functioning as spacer between the addenda in the surface layer and the adjacent recording layer unit. In another common variant form, addenda are distributed between the surface layer and the interlayer, with the latter containing addenda that are compatible with the adjacent recording layer unit. Most typically the SOC contains addenda, such as coating aids, plasticizers and lubricants, antistats and matting agents, such as illustrated by Research Disclosure, Item 38957, IX. Coating physical property modifying addenda. The SOC overlying the emulsion layers additionally preferably contains an ultraviolet absorber, such as illustrated by Research Disclosure, Item 38957, VI. UV dyes/optical brighteners/luminescent dyes, paragraph (1).

Instead of the layer unit sequence of elements SCN-1 and SCN-1a, alternative layer units sequences can be employed and are particularly attractive for some emulsion choices. Using high chloride emulsions and/or thin (<0.2 $\mu$m mean grain thickness) tabular grain emulsions all possible interchanges of the positions of BU, GU and RU can be undertaken without risk of blue light contamination of the minus blue records, since these emulsions exhibit negligible native sensitivity in the visible spectrum. For the same reason, it is unnecessary to incorporate blue light absorbers in the interlayers.

It is common practice to coat one, two or three separate emulsion layers within a single dye image-forming layer unit. When two or more emulsion layers are coated in a single layer unit, they are typically chosen to differ in sensitivity. When a more sensitive emulsion is coated over a less sensitive emulsion, a higher speed is realized than when the two emulsions are blended. When a less sensitive emulsion is coated over a more sensitive emulsion, a higher contrast is realized than when the two emulsions are blended. Triple coating, incorporating three separate emulsion layers within a layer unit, is a well known technique for facilitating extended exposure latitude, as illustrated by Chang et al U.S. Pat. Nos. 5,314,793 and 5,360,703.

When a layer unit is comprised of two or more emulsion layers, the units can be divided into sub-units, each containing emulsion and coupler, that are interleaved with sub-units of one or both other layer units. The following elements are illustrative:

Element SCN-2

SOC Surface Overcoat
BU Blue Recording Layer Unit
IL1 First Interlayer
FGU Fast Green Recording Layer Sub-Unit
IL2 Second Interlayer
FRU Fast Red Recording Layer Sub-Unit
IL3 Third Interlayer
SGU Slow Green Recording Layer Sub-Unit
IL4 Fourth Interlayer
SRU Slow Red Recording Layer Sub-Unit
S Support
AHU Antihalation Layer Unit
SOC Surface Overcoat Except for the division of the green recording layer unit into fast and slow sub-units FGU and SGU and the red recording layer unit into fast and slow sub-units FRU and SRU, the constructions and construction alternatives are essentially similar to those previously described from element SCN-1.

Element SCN-3

SOC Surface Overcoat
FBU Fast Blue Recording Layer Unit
IL1 First Interlayer
FGU Fast Green Recording Layer Sub-Unit
IL2 Second Interlayer
FRU Fast Red Recording Layer Sub-Unit
IL3 Third Interlayer
MBU Mid Blue Recording Layer Unit
IL4 Fourth Interlayer
MGU Mid Green Recording Layer Sub-Unit
IL5 Fifth Interlayer
MRU Mid Red Recording Layer Sub-Unit
IL6 Sixth Interlayer
SBU Slow Blue Recording Layer Sub-Unit
IL7 Seventh Interlayer
SGU Slow Green Recording Layer Sub-Unit
IL8 Eighth Interlayer
SRU Slow Red Recording Layer Sub-Unit
S Support
AHU Antihalation Layer Unit
SOC Surface Overcoat Except for the division of the blue, green and recording layer units into fast, mid and slow sub-units, the constructions and construction alternatives are essentially similar to those previously described from element SCN-1. Elements SCN-2a and SCN-3a can constructed by substituting in SCN-2 and SCN-3 the alternative arrangements of AHU, S and MRU described above, particularly the arrangement of SCN-1a.

When the emulsion layers within a dye image-forming layer unit differ in speed, it is conventional practice to limit the incorporation of dye image-forming coupler in the layer of highest speed to less than a stoichiometric amount, based on silver. The function of the highest speed emulsion layer is to create the portion of the characteristic curve just above the minimum density—i.e., in an exposure region that is below the threshold sensitivity of the remaining emulsion layer or layers in the layer unit. In this way, adding the increased granularity of the highest sensitivity speed emulsion layer to the dye image record produced is minimized without sacrificing imaging speed.

In the foregoing discussion the blue, green and red recording layer units are described as containing yellow, magenta and cyan image dye-forming couplers, respectively, as is conventional practice in color negative elements used for printing. In the color negative elements of the invention, which are intended for scanning to produce three separate electronic color records, the actual hue of the image dye produced is of no importance. What is essential is merely that the dye image produced in each of the layer units be differentiable from that produced by each of the remaining layer units. To provide this capability of differentiation it is contemplated that each of the layer units contain one or more dye image-forming couplers chosen to produce image dye having an absorption half-peak bandwidth lying in a different spectral region. It is immaterial whether the blue, green or red recording layer unit forms a yellow, magenta or cyan dye having an absorption half peak bandwidth in the blue, green or red region of the spectrum, as is conventional in a color negative element intended for use in printing, or an absorption half peak bandwidth in any other convenient region of the spectrum, ranging from the near ultraviolet (300–400 nm) through the visible and through the near infrared (700–1200 nm), so long as the absorption half peak bandwidths of the image dye in the layer units extend non-coextensive wavelength ranges. Preferably each image dye exhibits an absorption half-peak band width that extends over at least a 25 (most preferably 50) nm spectral region that is not occupied by an absorption half-peak band width of another image dye. Ideally the image dyes exhibit absorption half-peak band widths that are mutually exclusive.

When a layer unit contains two or more emulsion layers differing in speed, it is possible to lower image granularity in the image to be viewed, recreated from an electronic record, by forming in each emulsion layer of the layer unit a dye image which exhibits an absorption half peak band width that lies in a different spectral region than the dye images of the other emulsion layers of layer unit. This technique is particularly well suited to elements in which the layer units are divided into sub-units that differ in speed. This allows multiple electronic records to be created for each layer unit, corresponding to the differing dye images formed by the emulsion layers of the same spectral sensitivity. The digital record formed by scanning the dye image formed by an emulsion layer of the highest speed is used to recreate the portion of the dye image to be viewed lying just above minimum density. At higher exposure levels second and, optionally, third electronic records can be formed by scanning spectrally differentiated dye images formed by the remaining emulsion layer or layers. These digital records contain less noise (lower granularity) and can be used in recreating the image to be viewed over exposure ranges above the threshold exposure level of the slower emulsion layers. This technique for lowering granularity is disclosed in greater detail by Sutton U.S. Pat. No. 5,314,794, the disclosure of which is here incorporated by reference.

To realize an exposure latitude of at least 2.7, which is necessary to capture an acceptable range of color densities and to provide the photographer with some allowance for inaccuracies in the exposure settings, each layer unit of the color negative elements of the invention contains at least 0.8 $g/m^2$ silver in the form of silver halide and produces a dye image characteristic curve gamma of less than 1.5. A minimum acceptable exposure latitude of a multicolor photographic element is that which allows accurately recording the most extreme whites (e.g., a bride's wedding gown) and the most extreme blacks (e.g., a bride groom's tuxedo) that are likely to arise in photographic use. An exposure latitude of 2.6 log E can just accommodate the typical bride and groom wedding scene. An exposure latitude of at least 3.0 log E is preferred, since this allows for a comfortable margin of error in exposure level selection by a photographer. Even larger exposure latitudes are specifically preferred, since the ability to obtain accurate image reproduction with larger exposure errors is realized.

A silver coating coverage in each layer unit of at least 0.8 $g/m^2$ is necessary to realize an exposure latitude of at least 2.7 log E. Because of its less favored location, it is generally preferred that the red recording layer unit contain a silver coating coverage of at least 1.0 $g/m^2$. Silver coating coverages in each layer unit can usefully range up to 5.0 $g/m^2$. For most photographic applications optimum silver coverages are at least 1.0 $g/m^2$ in the blue recording layer unit and at least 2.5 $g/m^2$ in the green and red recording layer units.

Maintaining a gamma of less than 1.5 facilitates obtaining an exposure latitude of at least 2.7 log E. Whereas in color negative elements intended for printing, the visual attractiveness of the printed scene is often lost when gamma is exceptionally low, when color negative elements are scanned to create digital dye image records, contrast can be increased by adjustment of the electronic signal information. When the elements of the invention are scanned using a reflected beam, the beam travels through the layer units twice. This effectively doubles gamma ($\Delta D \div \Delta \log E$) by doubling changes in density ($\Delta D$). Thus, gamma's as low as 0.5 or even 0.2 are contemplated and exposure latitudes of up to about 5.0 log E or higher are feasible.

Exposure and processing of the color negative elements of the invention can take any convenient conventional form. The color negative elements are intended for in-camera exposure using ambient or artificial (e.g., flash) illumination. In preferred forms the color negative elements are processable in the Kodak Flexicolor™ C-41 process. Other variations of color negative processing are disclosed in Research Disclosure, Item 38957, XVIII. Chemical development systems and XIX. Development.

Once yellow, magenta and cyan dye image records have been formed in the processed photographic elements of the invention, conventional techniques can be employed for retrieving the image information for each color record and manipulating the record for subsequent creation of a color-balanced viewable image. For example, it is possible to scan the photographic element successively within the blue, green and red regions of the spectrum or to incorporate blue, green and red light within a single scanning beam that is divided and passed through blue, green and red filters to form separate scanning beams for each color record. A simple technique is to scan the photographic element point-by-point along a series of laterally offset parallel scan paths. The intensity of light passing through the element at a scanning point is noted by a sensor which converts radiation received into an electrical signal. The electrical signal is passed through an analog to digital converter and sent to a digital computer together with locant information required for pixel (point) location within the image.

One of the challenges encountered in producing images from information extracted by scanning is that the number of pixels of information available for viewing is only a fraction of that available from a comparable classical photographic print. It is therefore even more important in scan imaging to maximize the quality of the image information available. Enhancing image sharpness and minimizing the impact of aberrant pixel signals (i.e., noise) are common approaches to enhancing image quality. A conventional technique for minimizing the impact of aberrant pixel signals is to adjust each pixel density reading to a weighted average value by factoring in readings from adjacent pixels, closer adjacent pixels being weighted more heavily.

Illustrative systems of scan signal manipulation, including techniques for maximizing the quality of image records, are disclosed by Bayer U.S. Pat. No. 4,553,156, Urabe et al U.S. Pat. No. 4,591,923, Sasaki et al U.S. Pat. No. 4,631,578, Alkofer U.S. Pat. No. 4,654,722, Yamada et al U.S. Pat. No. 4,670,793, Klees U.S. Pat. Nos. 4,694,342 and 4,962,542, Powell U.S. Pat. No. 4,805,031, Mayne et al U.S. Pat. No. 4,829,370, Abdulwahab U.S. Pat. No. 4,839,721, Matsunawa et al U.S. Pat. Nos. 4,841,361 and 4,937,662, Mizukoshi et al U.S. Pat. No. 4,891,713, Petilli U.S. Pat. No. 4,912,569, Sullivan et al U.S. Pat. Nos. 4,920,501 and 5,070,413, Kimoto et al U.S. Pat. No. 4,929,979, Hirosawa et al U.S. Pat. No. 4,972,256, Kaplan U.S. Pat. No. 4,977,521, Sakai U.S. Pat. No. 4,979,027, Ng U.S. Pat. No. 5,003,494, Katayama et al U.S. Pat. No. 5,008,950, Kimura et al U.S. Pat. No. 5,065,255, Osamu et al U.S. Pat. No. 5,051,842, Lee et al U.S. Pat. No. 5,012,333, Bowers et al U.S. Pat. No. 5,107,346, Telle U.S. Pat. No. 5,105,266, MacDonald et al U.S. Pat. No. 5,105,469 and Kwon et al U.S. Pat. No. 5,081,692, the disclosures of which are here incorporated by reference. Techniques for color balance adjustments during scanning are disclosed by Moore et al U.S. Pat. No. 5,049,984 and Davis U.S. Pat. No. 5,541,645, the disclosures of which are incorporated by reference.

The digital color records once acquired are most instances adjusted to produce a pleasingly color balanced image for viewing, either on a video monitor or when printed as a conventional color print. Preferred techniques for color balancing after scanning are disclosed by Giorgianni et al U.S. Pat. No. 5,267,030 the disclosures of which are here incorporated by reference. The color balancing techniques of Giorgianni et al '030 described in connection with FIG. 8 represent a specifically preferred technique for obtaining a color-balanced image for viewing.

Further illustrations of the capability of those skilled in the art to manage color digital image information are provided by Giorgianni and Madden Digital Color Management, Addison-Wesley, 1998.

Broadly, the method of producing a viewable image is comprised of (a) recording image densities in the blue, green and red regions of the spectrum by scanning a color negative photographic element according to the invention that has been imagewise exposed and processed to produce a dye image in each of the layer units, (b) storing the image density information in a digital form, and (c) converting the image density information into a viewable color image. In a preferred form of the invention this is accomplished by (a) converting the scanner-generated image-bearing signals to scanner density signals, (b) transforming the scanner density signals to intermediary image-bearing signals, and (c) converting the intermediary image-bearing signals into a viewable color image. Although alternative color balancing techniques are known and can be employed, it is preferred, prior to converting the intermediary image-bearing signals to a viewable color image, to adjust the intermediary image-bearing signals to reduce unwanted absorptions of the dye images and interimage effects.

FIG. 1 shows, in block diagram form, one manner in which the image information provided by the color negative elements of the invention is contemplated to be used. An image scanner 12 is used to scan by transmission or reflection an imagewise exposed and photographically processed color negative element 14 according to the invention. The scanning beam is most conveniently a beam of white light that is split after passage through the layer units and passed through filters to create separate image records—red recording layer unit image record (R), green recording layer unit image record (G), and blue recording layer unit image record (B). Instead of splitting the beam, blue, green and red filters can be sequentially caused to intersect the beam at each pixel location. In still another scanning variation, separate blue, green and red light beams can be directed at each pixel location. As the element 12 is scanned pixel-by-pixel using a laser or photodiode or line-by-line using a photodiodide light bar, a sequence of R, G and B pixel signals are generated that can be correlated with spatial location information provided from the scanner. Signal intensity and locant information is fed to a workstation 16, and the information is transformed into an electronic form R', G' and B', which can be stored in any convenient storage device 18.

A common approach is to transfer the color negative film information into a video signal using a telecine transfer device. Two types of telecine transfer devices are most common: (1) a flying spot scanner using photomultiplier tube detectors or (2) charge coupled devices (CCD's) as sensors. These devices transform the scanning beam that has passed through the color negative film at each pixel location into a voltage. The signal processing then inverts the electrical signal in order to render a positive image. The signal is then amplified and modulated and fed into a cathode ray tube monitor to display the image or recorded onto magnetic tape for storage. Although both analog and digital image signal manipulations are contemplated, it is preferred to place the signal in a digital form for manipulation, since the overwhelming majority of computers are now digital and this facilitates use with common computer peripherals, such as magnetic tape, a magnetic disk, or an optical disk.

A video monitor 20, which receives the digital image information modified for its requirements, indicated by R", G" and B", allows viewing of the image information received by the work station. Instead of relying on a cathode ray tube of a video monitor, a liquid crystal display panel or any other convenient electronic image viewing device can be substituted. The video monitor typically relies upon a picture control apparatus 22, which can include a keyboard and cursor, for enabling the work station operator to provide image manipulation commands for modifying the video image displayed and any image to be recreated from the digital image information.

Any modifications of the image can be viewed as they are being introduced on the video display 20 and stored in the storage device 18. The modified image information R"', G"' and B"' can be sent to an output device 24 to produce a recreated image for viewing. The output device can be any convenient conventional element writer, such as a thermal, ink-jet, electrostatic or other type of printer. The output device can be used to control the exposure of a conventional silver halide color paper. The output device creates an output medium 26 that bears the recreated image for viewing. It is the image in the output medium that is ultimately viewed and judged by the end user for noise (granularity), sharpness, contrast, and color balance.

EXAMPLES

The invention can be better appreciated by reference to the following specific embodiments. All coating coverages are reported in parenthesis in terms of g/m$^2$, except as otherwise indicated. Silver halide coating coverages are reported in terms of silver. The symbol "M %" indicates mole percent.

Glossary of Acronyms

HBS-1 Tritoluoylphosphate
HBS-2 Di-n-butylphthalate
HBS-3 N-n-Butylacetanilide
HBS-4 Tris(2-ethylhexyl)phosphate
HBS-5 N,N-Diethyldodecanamide
H-1 Bis(vinylsulfonyl)methane
TAI 4-Hydroxy-6-methyl-1,3,3a,7-tetraazaindene, sodium salt

ST-1

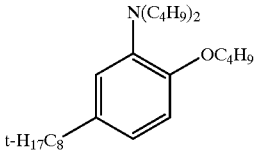

C-1

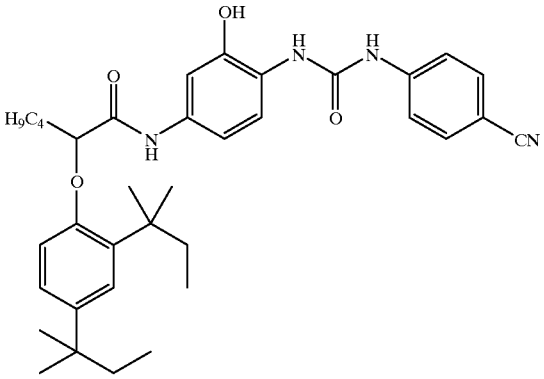

M-1

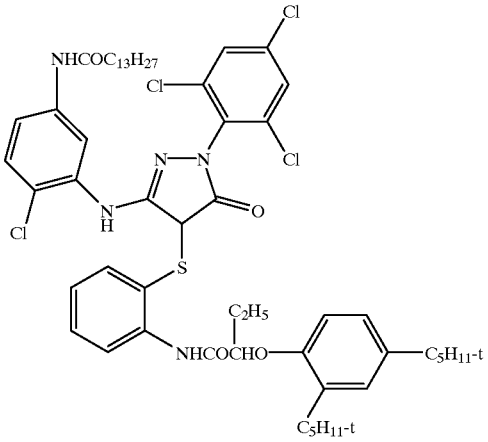

Y-1

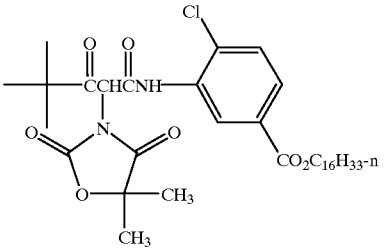

-continued
DIR-A
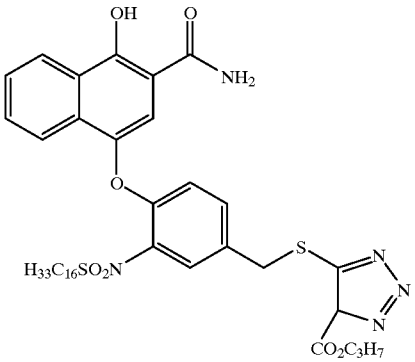
DIR-B
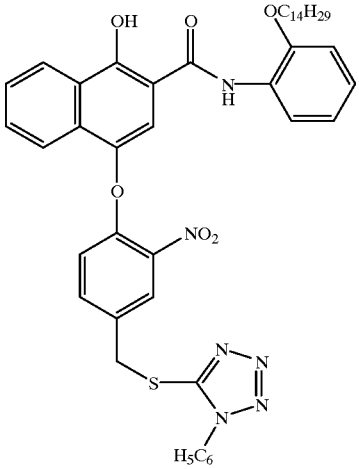
DIR-C
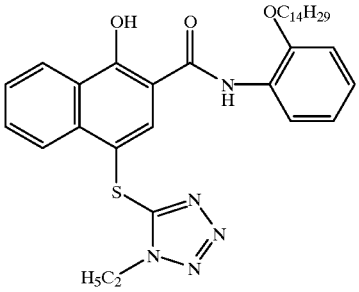
DIR-D
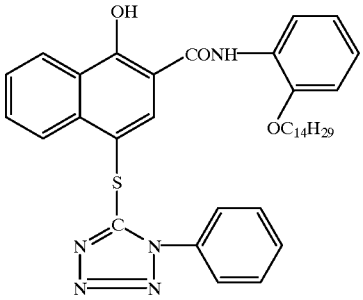
DIR-E
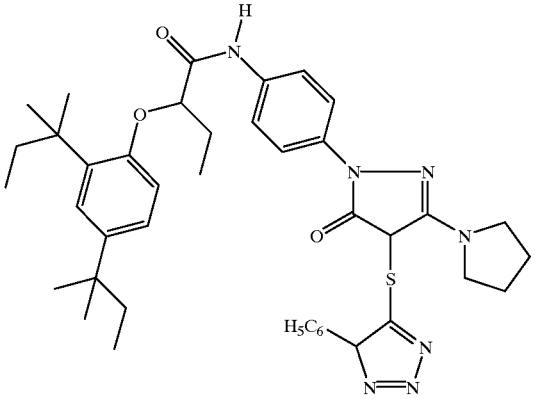
DIR-F
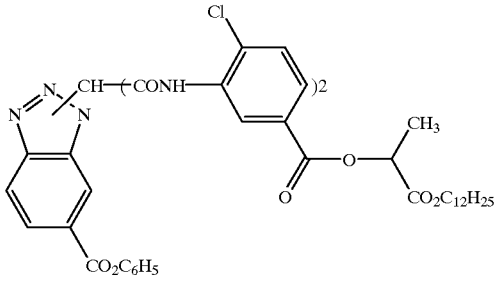

-continued
DIR-G
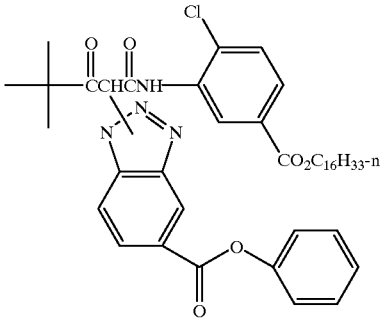
DIR-H
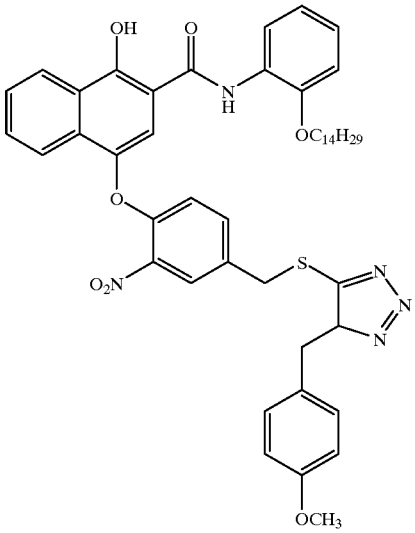
DIR-I
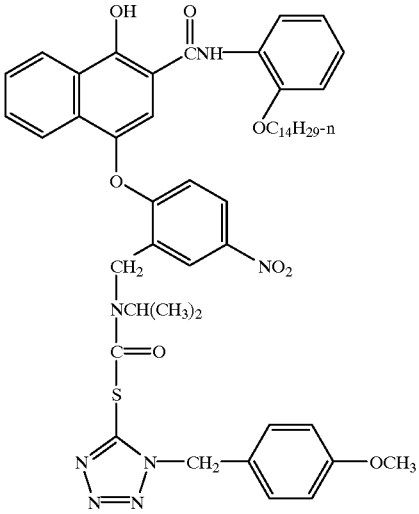
DIR-J
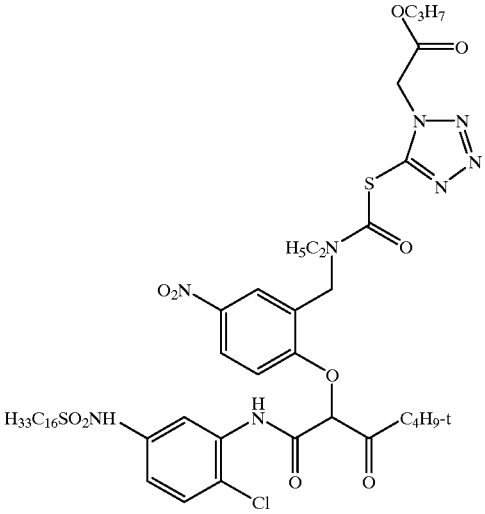
CM-1
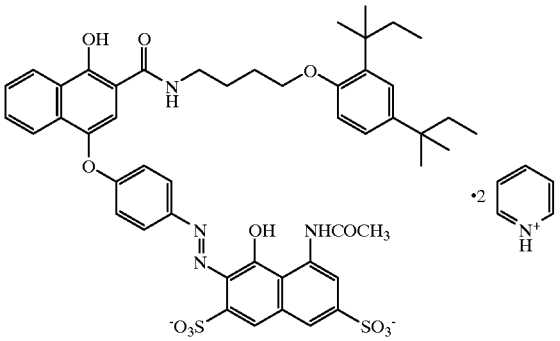
MM-1
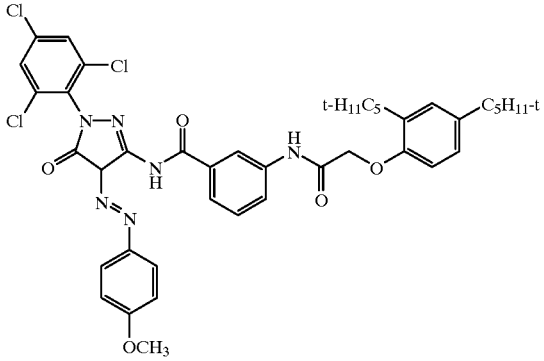

-continued
MM-2
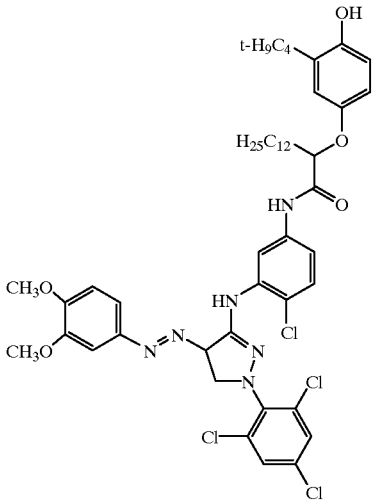
MD-1
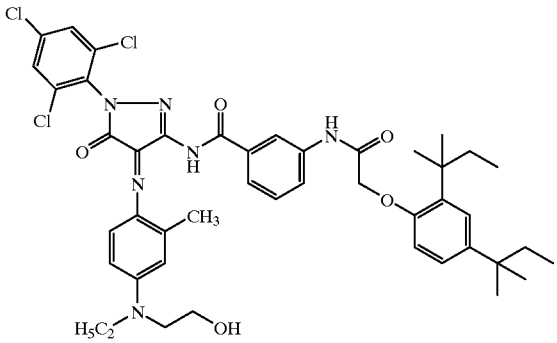
CD-1
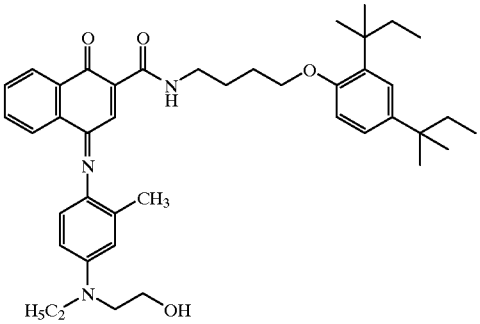
B-1
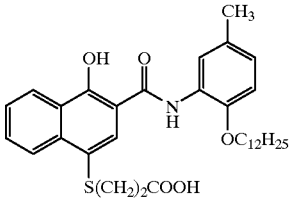
YD-1
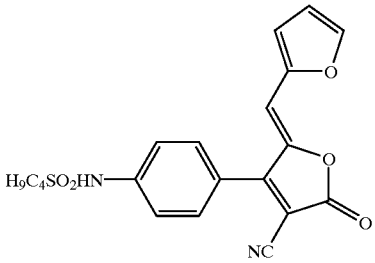
UV-1
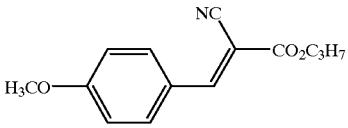
UV-2
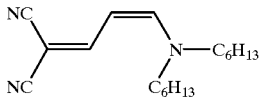
S-1
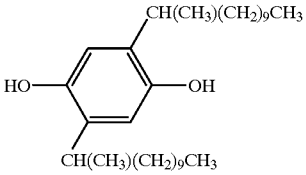
S-2
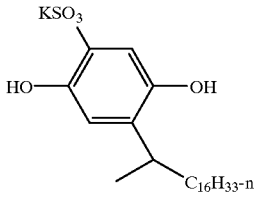

Diffusion Factor Determninations

For each DIR diffusion factor determination two samples, hereinafter referred to as samples 1 and 2, were prepared.

Test sample 1 was prepared by applying the following layers and a gelatin hardener to a clear support:

Layer 1 (a light sensitive layer)

cyan dye-forming image coupler C-1 (0.75),

AgIBr (0.5 μm ECD, 0.16 μm t)(1.72)

gelatin (0.81)

Layer 2 (overcoat)

gelatin (0.81).

Test sample 2 differed from test sample 1 only in that it additionally contained a fine grained unsensitized Lippmann emulsion (0.65) in the overcoat layer.

The diffusion factor for a selected DIR was conducted according to the following steps:

1) Test samples 1 and 2 were each exposed to white light through a graduated density test object and developed in the Kodak Flexicolor™ C-41 developer for 120 seconds at 38° C., followed by desilvering as in the C-41 process, and the density formation as a function of exposure (i.e., the characteristic curve of test sample 1) was determined.
2) For each development inhibitor to be tested, a series of developer solutions which differ from the C-41 developer only by the addition of the development inhibitor at varying concentrations were prepared. Additional portions of test sample 1 were processed as in step 1) above using the development inhibitor modified developers. A modified developer solution that results in a reduction in mid-scale density to about 50% was thereby identified to become the chosen developer.
3) An additional portion of test sample 2 was processed as in step 1) using the chosen developer.
4) The percent reduction in density formation for test sample 1 containing the development inhibitor was calculated by dividing the density formed at a mid-scale exposure step after processing in the chosen developer by the density formed at the same exposure step after processing test sample 1 as described in step 1) and subtracting this number from unity. As stated above, the concentration of development inhibitor in the chosen developer was chosen to set this value at about 50%.
5) The percent reduction in density formation caused by development inhibitor in test sample 2 was calculated by dividing the density formed at a mid-scale exposure step after processing in the chosen developer by the density formed at the same step after processing test sample 2 in the C-41 developer and subtracting this number from unity. When the development inhibitor or precursor thereof was highly adsorbed by the overlying Lippmann emulsion in test sample 2 and little development inhibitor was able to get through the overlying later, then there was little change in the underlying layer density formation and the percent reduction in density formation caused by the development inhibitor approached zero. Conversely, when the development inhibitor or precursor thereof was slightly adsorbed by the overlying Lippmann emulsion in test sample 2 and substantial inhibitor was able to get through the overlying later, then there was a substantial reduction in the underlying layer density formation and the percent reduction in density formation approached that observed with test sample 1, i.e. about 50%.
6) The diffusion factor of the development inhibitor was calculated by dividing the percent reduction determined in step 5 by the percent reduction determined in step 4. The diffusion factor thus varied from a minimum of zero, as occurs when the development inhibitor is strongly adsorbed to the Lippmann emulsion, to a value of unity (1), as occurs when the development inhibitor or precursor thereof is weakly or not adsorbed by the Lippmann emulsion. When the development inhibitor precursor promptly releases a development inhibitor, essentially similar diffusion factors are obtained, whether the entire development inhibitor precursor or only its released development inhibitor are employed. When the release linkage of the development inhibitor to the remainder of the development inhibitor precursor significantly retards release, the development inhibitor precursor itself must be tested to determine accurately its diffusion factor.

To facilitate replication of diffusion factor determinations, the following specifics of the Kodak Flexicolor ™ C-41 process are provided:

| | | |
|---|---|---|
| Develop | 195" Developer | 38° C. |
| Bleach 240" | Bleach | 38° C. |
| Wash | 180" | ca 35° C. |
| Fix | 240" Fixer | 38° C. |
| Wash | 180" | ca 35° C. |
| Rinse 60" | Rinse | ca 35° C. |

Developer

| | |
|---|---|
| Water | 800.0 mL |
| Potassium Carbonate, anhydrous | 34.30 g |
| Potassium bicarbonate | 2.32 g |
| Sodium sulfite, anhydrous | 0.38 g |
| Sodium metabisulfite | 2.96 g |
| Potassium Iodide | 1.20 mg |
| Sodium Bromide | 1.31 g |
| Diethylenetriaminepentaacetic acid pentasodium salt (40% soln) | 8.43 g |
| Hydroxylamine sulfate | 2.41 g |
| N-(4-amino-3-methylphenyl)-N-ethyl-2-aminoethanol | 4.52 g |
| Water to make | 1.0 L |
| pH @ 26.7° C. 10.00 +/− 0.05 | |

Bleach

| | |
|---|---|
| Water | 500.0 mL |
| 1,3-Propylenediamine tetra-acetic acid | 37.4 g |
| 57% Ammonium hydroxide | 70.0 mL |
| Acetic acid | 80.0 mL |
| 2-Hydroxy-1,3-propylenediamine tetraacetic acid | 0.8 g |
| Ammonium Bromide | 25.0 g |
| Ferric nitrate nonahydrate | 44.85 g |
| Water to make | 1.0 L |
| pH 4.75 | |

Fix

| | |
|---|---|
| Water | 500.0 mL |
| Ammonium Thiosulfate (58% solution) | 214.0 g |
| (Ethylenedinitrilo)tetraacetic acid disodium salt, dihydrate | 1.29 g |
| Sodium metabisulfite | 11.0 g |
| Sodium Hydroxide (50% solution) | 4.70 g |
| Water to make | 1.0 L |
| pH at 26.7° C. 6.5 +/− 0.15 | |

-continued

| Kodak Flexicolor ™ C-41 process are provided: | |
|---|---|
| Rinse | |
| Water | 900.0 mL |
| 0.5% Aqueous p-tertiary-octyl-(α-phenoxypolyethyl)alcohol | 3.0 mL |
| Water to make | 1.0 L |

Using the testing procedure described above, the following are diffusion factors of representative DIR compounds:

TABLE I

| DIR | Diffusion Factor |
|---|---|
| A | 0.8 |
| B | 0.3 |
| C | 0.7 |
| D | 0.2 |
| E | 0.2 |
| F | 0.7 |
| G | 0.7 |
| H | 0.3 |
| I | 0.3 |
| J | 0.8 |

Color Negative Elements

Sample 101 (comparative control)

This sample was prepared by applying the following layers in the sequence recited to a transparent film support of cellulose triacetate with conventional subbing layers, with the red recording layer unit coated nearest the support. The side of the support to be coated had been prepared by the application of gelatin subbing.

| Layer 1: AHU | |
|---|---|
| Black colloidal silver sol | (0.107) |
| UV-1 | (0.075) |
| UV-2 | (0.075) |
| Oxidized developer scavenger S-1 | (0.161) |
| Compensatory printing density cyan dye CD-1 | (0.034) |
| Compensatory printing density magenta dye MD-1 | (0.013) |
| Compensatory printing density yellow dye MM-1 | (0.095) |
| HBS-1 | (0.105) |
| HBS-2 | (0.399) |
| HBS-4 | (0.013) |
| Disodium salt of 3,5-disulfocatechol | (0.215) |
| Gelatin | (2.152) |

Layer 2:SRU

This layer was comprised of a blend of a lower and higher (lower and higher grain ECD) sensitivity, red-sensitized tabular silver iodobromide emulsions respectively containing 1.5 M % and 4.1 M % iodide, based on silver.

| | |
|---|---|
| AgIBr (0.55 μm ECD, 0.08 μm t) | (0.355) |
| AgIBr (0.66 μm ECD, 0.12 μm t) | (0.328) |
| Bleach accelerator coupler B-1 | (0.075) |
| DIR-B | (0.018) |
| Cyan dye forming coupler C-1 | (0.359) |
| HBS-2 | (0.359) |
| HBS-3 | (0.034) |

-continued

| | |
|---|---|
| HBS-5 | (0.098) |
| TAI | (0.011) |
| Gelatin | (1.668) |

Layer 3:MRU

This layer was comprised of a red-sensitized tabular silver iodobromide emulsion containing 4.1 M % iodide, based on silver.

| | |
|---|---|
| AgIBr (1.30 μm ECD, 0.12 μm t) | (1.162) |
| Bleach accelerator coupler B-1 | (0.005) |
| DIR-B | (0.018) |
| Cyan dye forming magenta colored coupler CM-1 | (0.059) |
| Cyan dye forming coupler C-1 | (0.207) |
| HBS-2 | (0.207) |
| HBS-3 | (0.037) |
| HBS-5 | (0.007) |
| TAI | (0.019) |
| Gelatin | (1.291) |

Layer 4:FRU

This layer was comprised of a red-sensitized tabular silver iodobromide emulsion containing 3.7 M % iodide, based on silver.

| | |
|---|---|
| AgIBr (2.61 μm ECD, 0.12 μm t) | (1.060) |
| Bleach accelerator coupler B-1 | (0.005) |
| DIR-C | (0.048) |
| DIR-B | (0.030) |
| Cyan dye forming magenta colored coupler CM-1 | (0.022) |
| Cyan dye forming coupler C-1 | (0.312) |
| HBS-1 | (0.194) |
| HBS-2 | (0.274) |
| HBS-3 | (0.060) |
| HBS-5 | (0.007) |
| TAI | (0.010) |
| Gelatin | (1.291) |

Layer 5:Interlayer

| | |
|---|---|
| Oxidized developer scavenger S-1 | (0.086) |
| HBS-4 | (0.129) |
| Gelatin | (0.538) |

Layer 6:SGU

This layer was comprised of a blend of a lower and higher (lower and higher grain ECD) sensitivity, green-sensitized tabular silver iodobromide emulsions respectively containing 2.6 M % and 4.1 M % iodide, based on silver.

| | |
|---|---|
| AgIBr (0.81 μm ECD, 0.12 μm t) | (0.251) |
| AgIBr (0.92 μm ECD, 0.12 μm t) | (0.110) |
| Magenta dye forming yellow colored coupler MM-2 | (0.054) |
| Magenta dye forming coupler M-1 | (0.339) |
| Stabilizer ST-1 | (0.034) |
| HBS-1 | (0.413) |
| TAI | (0.006) |
| Gelatin | (1.721) |

Layer 7:MGU

This layer was comprised of a blend of a lower and higher (lower and higher grain ECD) sensitivity, green-sensitized tabular silver iodobromide emulsions each containing 4.1 M % iodide, based on silver.

| | |
|---|---|
| AgIBr (0.92 μm ECD, 0.12 μm t) | (0.113) |
| AgIBr (1.22 μm ECD, 0.11 μm t) | (1.334) |
| DIR-F | (0.032) |
| Magenta dye forming yellow colored coupler MM-2 | (0.118) |
| Magenta dye forming coupler M-1 | (0.087) |
| Oxidized developer scavenger S-2 | (0.018) |
| HBS-1 | (0.315) |
| HBS-2 | (0.032) |
| Stabilizer ST-1 | (0.009) |
| TAI | (0.023) |
| Gelatin | (1.668) |

Layer 8:FGU

This layer was comprised of a green-sensitized tabular silver iodobromide emulsion containing 4.1 M % iodide, based on silver.

| | |
|---|---|
| AgIBr (2.49 μm ECD, 0.14 μm t) | (0.909) |
| DIR-E | (0.003) |
| DIR-F | (0.027) |
| Magenta dye forming yellow colored coupler MM-2 | (0.054) |
| Magenta dye forming coupler M-1 | (0.113) |
| HBS-1 | (0.216) |
| HBS-2 | (0.027) |
| Stabilizer ST-1 | (0.011) |
| TAI | (0.011) |
| Gelatin | (1.405) |

Layer 9:Yellow Filter Layer

| | |
|---|---|
| Yellow filter dye YD-1 | (0.054) |
| Oxidized developer scavenger S-1 | (0.086) |
| HBS-4 | (0.129) |
| Gelatin | (0.646) |

Layer 10:SBU

This layer was comprised of a blend of a lower, medium and higher (lower, medium and higher grain ECD) sensitivity, blue-sensitized tabular silver iodobromide emulsions respectively containing 1.5 M %, 1.5 M % and 4.1 M % iodide, based on silver.

| | |
|---|---|
| AgIBr (0.55 μm ECD, 0.08 μm t) | (0.156) |
| AgIBr (0.77 μm ECD, 0.14 μm t) | (0.269) |
| AgIBr (1.25 μm ECD, 0.14 μm t) | (0.430) |
| DIR-B | (0.030) |
| DIR-G | (0.054) |
| Yellow dye forming coupler Y-1 | (1.022) |
| Bleach accelerator coupler B-1 | (0.011) |
| HBS-1 | (0.538) |
| HBS-3 | (0.060) |
| HBS-5 | (0.014) |
| TAI | (0.014) |
| Gelatin | (2.119) |

Layer 11:FBU

This layer was comprised of a blue-sensitized tabular silver iodobromide emulsion containing 9.0 M % iodide, based on silver.

| | |
|---|---|
| AgIBr (1.04 μm ECD) | (0.699) |
| Unsensitized silver bromide Lippmann emulsion | (0.054) |
| Yellow dye forming coupler Y-1 | (0.473) |
| DIR-G | (0.086) |
| Bleach accelerator coupler B-1 | (0.005) |
| HBS-1 | (0.280) |
| HBS-5 | (0.004) |
| TAI | (0.012) |
| Gelatin | (1.183) |

Layer 12:Ultraviolet Filter Layer

| | |
|---|---|
| Dye UV-1 | (0.108) |
| Dye UV-2 | (0.108) |
| Unsensitized silver bromide Lippmann emulsion | (0.215) |
| HBS-1 | (0.151) |
| Gelatin | (0.699) |

Layer 13:Protective Overcoat Layer

| | |
|---|---|
| Polymethylmethacrylate matte beads | (0.005) |
| Soluble polymethylmethacrylate matte beads | (0.108) |
| Silicone lubricant | (0.039) |
| Gelatin | (0.882) |

This film was hardened at the time of coating with 1.80% by weight of total gelatin of hardener H-1. Surfactants, coating aids, soluble absorber dyes, antifoggants, stabilizers, antistatic agents, biostats, biocides, and other addenda chemicals were added to the various layers of this sample, as is commonly practiced in the art.

Sample 102 (comparative control)

Except as indicated below, this sample was prepared as described above in connection with Sample 101.

| | |
|---|---|
| Layer 3: MRU Changes | |
| Cyan dye forming magenta colored coupler CM-1 | (0.000) |
| Layer 4: FRU Changes | |
| Cyan dye forming magenta colored coupler CM-1 | (0.000) |
| Layer 6: SGU Changes | |
| Magenta dye forming yellow colored coupler MM-2 | (0.000) |
| HBS-1 | (0.306) |
| Layer 7: MGU Changes | |
| Magenta dye forming yellow colored coupler MM-2 | (0.000) |
| HBS-1 | (0.079) |
| Layer 8: FGU Changes | |
| Magenta dye forming yellow colored coupler MM-2 | (0.000) |
| HBS-1 | (0.108) |

Sample 103 (comparative control)

Except as indicated below, this sample was prepared as described above in connection with Sample 101.

| | |
|---|---|
| Layer 2: SRU Changes | |
| DIR-B | (0.000) |
| DIR-D | (0.011) |

-continued

| | |
|---|---|
| HBS-1 | (0.044) |
| HBS-3 | (0.000) |
| Layer 3: MRU Changes | |
| DIR-B | (0.000) |
| DIR-D | (0.011) |
| HBS-1 | (0.044) |
| HBS-3 | (0.000) |
| Layer 4: FRU Changes | |
| DIR-C | (0.011) |
| DIR-B | (0.000) |
| DIR-D | (0.015) |
| HBS-1 | (0.103) |
| HBS-2 | (0.312) |
| HBS-3 | (0.000) |
| Layer 6: SGU Changes | |
| DIR-E | (0.011) |
| HBS-1 | (0.435) |
| Layer 7: MGU Changes | |
| DIR-F | (0.000) |
| DIR-E | (0.011) |
| HBS-1 | (0.337) |
| HBS-2 | (0.000) |
| Layer 8: FGU Changes | |
| DIR-F | (0.000) |
| DIR-E | (0.015) |
| HBS-1 | (0.240) |
| HBS-2 | (0.000) |
| Layer 10: SBU Changes | |
| DIR-B | (0.000) |
| DIR-G | (0.000) |
| DIR-A | (0.011) |
| HBS-1 | (0.511) |
| HBS-2 | (0.022) |
| HBS-3 | (0.000) |
| Layer 11: FBU Changes | |
| DIR-G | (0.000) |
| DIR-A | (0.011) |
| HBS-1 | (0.237) |

Sample 104 (invention)

Except as indicated below, this sample was prepared as described above in connection with Sample 103.

| | |
|---|---|
| Layer 3: MRU Changes | |
| Cyan dye forming magenta colored coupler CM-1 | (0.000) |
| Layer 4: FRU Changes | |
| Cyan dye forming magenta colored coupler CM-1 | (0.000) |
| Layer 6: SGU Changes | |
| Magenta dye forming yellow colored coupler MM-2 | (0.000) |
| HBS-1 | (0.327) |
| Layer 7: MGU Changes | |
| Magenta dye forming yellow colored coupler MM-2 | (0.000) |
| HBS-1 | (0.100) |
| Layer 8: FGU Layer Changes | |
| Magenta dye forming yellow colored coupler MM-2 | (0.000) |
| HBS-1 | (0.132) |

TABLE II

| Sample | DIR's | Mole % DIR's with Diffusion Factor <0.4 |
|---|---|---|
| 101 (cont.) | B,C,E,F,G | 28 |
| 102 (cont.) | B,C,E,F,G | 28 |
| 103 (cont.) | A,C,D,E | 70 |
| 104 (inven.) | A,C,D,E | 70 |

Evaluations of Samples

The samples were identically imagewise exposed and processed using the Kodak Flexicolor™ C-41 process. Using an arrangement of the type shown in FIG. 1, the images contained in the samples were converted to digital form, manipulated and recreated in a viewable form for evaluation following the procedure described in Giorgianni et al U.S. Pat. No. 5,267,030, previously cited and incorporated by reference.

Signal manipulation was conducted as follows:

(1) The R, G and B signals, which correspond to the measured transmittances of the sample, were converted to corresponding densities in the computer used to receive and store the signals.

(2) The adjusted densities from step (1) were then adjusted to remove the chromatic interdependence of the image-bearing signals resulting from the unwanted absorptions of the imaging dyes and/or by chemical interlayer interimage effects of Samples 101–104 in order to produce channel independent density values.

(3) The adjusted densities from step (2) were then transformed using lookup tables, derived from the neutral scale densities of the samples, to create corresponding linear exposure values.

(4) The linear exposure values were then converted with respect to the CCIR Recommendation 709 color matching function.

To produce the transformations of steps (2) and (4) as taught by Giorgianni et al, cited above, additional sets of Samples 101–104 were required. In these additional sets Samples 101–104 in 135 roll format were exposed with a pictorial scene incorporating neutral gray patches and red, green, blue, cyan, magenta, and yellow color patches to provide a test image, and with an additional color-patch scene using 52 color variations and 12 neutral patches using a single-lens reflex camera. Samples 101–104 were additionally exposed to a color-patch chart using 125 color variations and 25 neutral patches (derived through additive exposures). All of the exposed films were processed through the Kodak Flexicolor™ C-41 process. The patches and images recorded on Samples 101–104 were scanned with a KODAK PROFESSIONAL PCD™ Film Scanner 2000. The resulting scanner densities from one color patch set were used to determine a film-dependent inverse color correction matrix of step (3) above referred to as MAT_A for each film, which is reported in Table III.

TABLE III

| Sample | 3 × 3 Matrix MAT_A Values | | |
|---|---|---|---|
| 101 | 0.7973 | 0.0848 | 0.1179 |
| | 0.0882 | 0.7173 | 0.1945 |
| | −0.0599 | 0.0142 | 1.0458 |

TABLE III-continued

| Sample | 3 × 3 Matrix MAT_A Values | | |
|---|---|---|---|
| 102 | 0.7111 | 0.1421 | 0.1467 |
| | −0.0033 | 0.7877 | 0.2156 |
| | −0.0330 | −0.2242 | 1.2572 |
| 103 | 0.8466 | 0.0608 | 0.0926 |
| | 0.0207 | 0.9069 | 0.0725 |
| | −0.1447 | 0.0350 | 1.1097 |
| 104 | 0.8233 | 0.0842 | 0.0924 |
| | −0.0496 | 0.9559 | 0.0938 |
| | −0.1110 | −0.1963 | 1.3074 |

These 3×3 matrix values were used to remove the interdependence of the image-bearing signals resulting from the unwanted absorptions of the imaging dyes and/or by chemical interlayer interimage effects of Samples 101–104 in order to produce channel independent density values. The second color-patch scene images recorded in scanner densities were then converted to exposure values, and a mathematical regression was performed to render the exposure values resulting from the samples' individual spectral sensitivities to those of a reference image capture device, in order to provide matrix values allowing a transformation of the image bearing signals as in step (5) above. The color matching functions of the CCIR Recommendation 709, Basic Parameter Values for the HDTV Standard for the Studio and for International Programme Exchange, published May 24, 1990, were used as a reference color system, where the reference illuminant was defined as D6500. These film-dependent linear space 3×3 matrix values, termed MAT_B, are listed in Table IV and were used to define exposure values of Samples 101–104 images that correspond to calorimetric values relating to the display primary colors.

TABLE IV

| Sample | 3 × 3 Matrix MAT_B Values | | |
|---|---|---|---|
| 101 | 1.502 | −0.330 | −0.172 |
| | −0.005 | 1.094 | −0.089 |
| | 0.002 | −0.161 | 1.160 |
| 102 | 1.603 | −0.440 | −0.163 |
| | −0.004 | 1.153 | −0.149 |
| | −0.005 | −0.172 | 1.177 |
| 103 | 1.532 | −0.363 | −0.169 |
| | −0.008 | 1.111 | −0.103 |
| | 0.004 | −0.167 | 1.163 |
| 104 | 1.635 | −0.467 | −0.168 |
| | −0.007 | 1.182 | −0.175 |
| | −0.004 | −0.176 | 1.180 |

The pictorial scene, including neutral and color patches recorded on Samples 101–104 was scanned for each sample with the PCD Film Scanner 2000 programmed with the samples' respective unique MAT_A and MAT_B matrix values. The application of these film-dependent matrix values thus allowed for the extraction of the recorded test scene exposure information from each input film sample and expression of the exposure values in terms of CCIR Recommendation 709 color matching functions. Subsequently, the image bearing signals were normalized for the exposure, color balance and gamma of the input photographic recording material, and the signals were converted to intermediary reference video R", G", B" image-bearing signals, as illustrated in FIG. 1. These intermediary image-bearing signals or encoded values were an accurate representation of the exposures of the original scene, which was verified by examination of the video image produced by each sample.

The code values of the 20% reflectance neutral patch of pictorial scene recorded on each sample were normalized in terms of the CCIR 709 video code values where black had a value of 0, a 90% reflectance patch had a value of 235, and a 20% reflectance gray patch had a value of 107. The image recorded on each film was displayed on a video monitor, and the neutral, red, green, and blue patch code values (relating to image patch density that would be rendered in a print) and their standard deviations (relating directly to final image noise) were determined. The midtone 20% neutral patch mean code values of photographic recording materials Samples 101–104, comprising equal R", G", B" image-bearing signals, as illustrated in FIG. 1, and their standard deviations (indicative of image noise and hence granularity in the Samples 101–104) are reported in Table V.

TABLE V

| | 20% Neutral Patch Mean Code Values | | | 20% Neutral Patch Standard Deviations | | |
|---|---|---|---|---|---|---|
| Sample | R" | G" | B" | R" | G" | B" |
| 101(Comp.) | 107.1 | 107.2 | 107.4 | 6.9 | 4.5 | 8.7 |
| 102(Comp.) | 107.0 | 107.1 | 107.3 | 6.1 | 4.1 | 8.2 |
| 103(Comp.) | 106.8 | 107.1 | 107.1 | 6.0 | 4.1 | 9.4 |
| 104(Inv.) | 106.8 | 107.0 | 106.9 | 5.8 | 3.6 | 7.7 |

From Table V it is apparent that the lowest signal deviations (noise) were exhibited by Sample 104, which satisfies the requirements of the invention. This confirms the ability of the color negative element samples satisfying invention requirements to reduce image noise in intermediate images recreated from digital records extracted from neutral patch image areas of color negative elements.

The red, green and blue color patch primary R", G", B" image-bearing signals, respectively, and their standard deviations are reported in Table VI.

TABLE VI

| | Primary Color Patch Mean Code Values | | | Primary Color Patch Standard Deviations | | |
|---|---|---|---|---|---|---|
| Sample | R" | G" | B" | R" | G" | B" |
| 101(Comp.) | 202.2 | 122.4 | 156.3 | 8.1 | 4.7 | 9.5 |
| 102(Comp.) | 178.7 | 121.5 | 154.4 | 7.1 | 4.7 | 10.6 |
| 103(Comp.) | 178.3 | 120.8 | 153.9 | 6.5 | 3.9 | 8.8 |
| 104(Inv.) | 167.2 | 116.3 | 148.7 | 5.9 | 2.5 | 4.9 |

From Table VI it is apparent that the lowest signal deviations (noise) were exhibited by Sample 104, which satisfies the requirements of the invention. This confirms the ability of the color negative element samples satisfying invention requirements to reduce image noise in intermediate images recreated from digital records extracted from color patch image areas of color negative elements.

To illustrate further the advantages in recreated images derived through intermediate digital records obtained by scanning the color negative elements of the invention, the coefficients of variation (COV) of the signals R", G" and B" are reported, where COV is standard deviation divided by mean signal amplitude and converted to a percentage by being multiplied by 100.

TABLE VII

| Sample | Primary Color Patch Standard Deviations | | | Primary Color Patch COV's | | |
|---|---|---|---|---|---|---|
| | R" | G" | B" | R" | G" | B" |
| 101(Comp.) | 8.1 | 4.7 | 9.5 | 8.0 | 3.8 | 6.1 |
| 102(Comp.) | 7.1 | 4.7 | 10.6 | 4.0 | 3.9 | 6.9 |
| 103(Comp.) | 6.5 | 3.9 | 8.8 | 3.6 | 3.2 | 5.7 |
| 104(Inv.) | 5.9 | 2.5 | 4.9 | 3.5 | 2.1 | 3.3 |

Although noise reduction was demonstrated in each of the red, green and blue records, it is appreciated Sample 104 could have been constructed with only one or two of the red, green and blue recording layer units satisfying the requirements of the invention with the noise reduction benefits being obtained.

To visually verify the improvement in the image quality produced by the color negative elements of the invention, the image information in the computer employed as a work station was supplied to a Light Valve Technology™ printer to create a viewable image using Ektacolor™ color print material. The Ektacolor print images produced using image signals generated from Sample 104 were observed to exhibit lower granularity than the images produced using Samples 101–103. This provided a visual confirmation of the advantages of the invention.

The invention has been described in detail with particular reference to preferred embodiments thereof, but it will be understood that variations and modifications can be effected within the spirit and scope of the invention.

What is claimed is:

1. A color negative photographic element for producing a color image suited for conversion to an electronic form and subsequent reconversion into a viewable form comprised of a support and, coated on the support, a plurality of hydrophilic colloid layers, including radiation-sensitive silver halide emulsion layers, forming layer units for separately recording blue, green and red exposures, each of the layer units containing dye image-forming coupler chosen to produce image dye having an absorption half-peak bandwidth lying in a different spectral region in each layer unit,

WHEREIN the layer units each contain less than 0.05 millimole/$m^2$ of colored masking coupler, the layer units each contain at least 0.8 g/$m^2$ of silver in the form of silver halide and exhibit a dye image gamma of from 0.2 to less than 1.5 and an exposure latitude of at least 2.7 log E, where E is exposure measured in lux-seconds, development inhibitor releasing compound is present in at least one of layer units, and greater than 50 mole percent of the development inhibitor compound in at least one of the layer units exhibits a diffusion factor of less than 0.4.

2. A color negative element for producing a color image suited for electronic conversion and subsequent reconversion into a viewable form according to claim 1 wherein the red recording layer unit contains a cyan dye image-forming coupler, the green recording layer unit contains a magenta dye image-forming coupler, and the blue recording layer unit contains a yellow dye image-forming coupler.

3. A color negative element for producing a color image suited for electronic conversion and subsequent reconversion into a viewable form according to claim 1 wherein greater than 50 mole percent of the development inhibitor compound in each of the layer units exhibits a diffusion factor of less than 0.4.

4. A color negative element for producing a color image suited for electronic conversion and subsequent reconversion into a viewable form according to claim 1 wherein at least one of the layer units contains two or more emulsion layers differing in sensitivity.

5. A color negative element for producing a color image suited for electronic conversion and subsequent reconversion into a viewable form according to claim 4 wherein the emulsion layer having the highest sensitivity is associated with dye image-forming coupler that produces a dye image of a different hue than the dye image-forming coupler associated with remaining of the emulsions layers in the same layer unit.

6. A color negative element for producing a color image suited for electronic conversion and subsequent reconversion into a viewable form according to claim 4 wherein each of the red recording and green recording layer units are divided into two or more sub-units and radiation-sensitive silver halide emulsions contained in different sub-units of the same layer unit differ in sensitivity.

7. A color negative element for producing a color image suited for electronic conversion and subsequent reconversion into a viewable form according to claim 6 wherein the sub-units that exhibit a higher sensitivity contain less than a stoichiometric concentration of dye image-forming coupler, based on silver.

8. A color negative element for producing a color image suited for electronic conversion and subsequent reconversion into a viewable form according to claim 1 wherein the radiation-sensitive silver halide emulsions contain greater than 50 mole percent bromide, based on silver.

9. A color negative for producing a color image suited for electronic conversion and subsequent reconversion into a viewable form according to claim 8 the radiation-sensitive emulsions are silver iodobromide emulsions.

10. A method of producing a viewable image comprised of recording image densities in the blue, green and red regions of the spectrum by scanning a color negative photographic element according to claim 1 that has been imagewise exposed and processed to produce a dye image in each of the layer units, storing the image density information in a digital form, and converting the image density information into a viewable color image.

11. A method of producing a viewable image by transforming scanner-generated image-bearing signals produced by scanning a color negative element according to any one of claims 1–9 inclusive that has been imagewise exposed and processed to produce a dye image in each of the layer units comprised of converting the scanner-generated image-bearing signals to scanner density signals, transforming the scanner density signals to intermediary image-bearing signals, and converting the intermediary image-bearing signals into a viewable color image.

12. A method according to claim 11 wherein, prior to converting the intermediary image-bearing signals to a viewable color image, the intermediary image-bearing signals are adjusted to reduce unwanted absorptions of the dye images and interimage effects.

* * * * *